US007825868B2

(12) United States Patent
Sabet et al.

(10) Patent No.: US 7,825,868 B2
(45) Date of Patent: Nov. 2, 2010

(54) HAND HELD READER ANTENNA FOR RFID AND TIRE PRESSURE MONITORING SYSTEM

(75) Inventors: Kazem F. Sabet, Ann Arbor, MI (US); Kamal Sarabandi, Ann Arbor, MI (US); Linda P. B. Katehi, Zionsville, IN (US); Jiyoun Munn, Ann Arbor, MI (US)

(73) Assignee: EMAG Technologies, Inc., Ann Arbor, MI (US)

( * ) Notice: Subject to any disclaimer, the term of this patent is extended or adjusted under 35 U.S.C. 154(b) by 642 days.

(21) Appl. No.: 11/764,060

(22) Filed: Jun. 15, 2007

(65) Prior Publication Data

US 2008/0309567 A1 Dec. 18, 2008

(51) Int. Cl.
*H01Q 1/38* (2006.01)
*H01Q 21/00* (2006.01)

(52) U.S. Cl. ..... 343/767; 343/700 MS; 343/725

(58) Field of Classification Search ..... 343/700 MS, 343/702, 767, 853, 895, 725, 893
See application file for complete search history.

(56) References Cited

U.S. PATENT DOCUMENTS 5,872,545 A * 2/1999 Rammos ..... 343/770
6,091,373 A * 7/2000 Raguenet ..... 343/778

* cited by examiner

*Primary Examiner*—Michael C Wimer
(74) *Attorney, Agent, or Firm*—John A. Miller; Miller IP Group, PLC

(57) ABSTRACT

An antenna assembly that has particular application for a hand held reader that interrogates sensors embedded within a vehicle tire, such as RFID sensors and tire pressure sensors. In one embodiment, the antenna assembly includes a first antenna operating in the 432-435 MHz range that employs a meander-line slot that provides increased antenna cross-polarization so that the sensor can be interrogated regardless of the antenna orientation and polarization. The antenna assembly also includes two RFID antennas that operate in the 902-928 MHz range that are planar antenna that make the antenna bi-directional, polarization free and a wide enough bandwidth for the RFID interrogation.

24 Claims, 3 Drawing Sheets

HAND HELD READER ANTENNA FOR RFID AND TIRE PRESSURE MONITORING SYSTEM

BACKGROUND OF THE INVENTION

1. Field of the Invention

This invention relates generally to an antenna for a vehicle tire interrogation system that interrogates a tire sensor and, more particularly, to an antenna for a hand held reader for a vehicle tire interrogation system that is able to interrogate a tire pressure sensor and a radio frequency identification (RFID) sensor.

2. Discussion of the Related Art

Heavy trucks and other vehicles are extensively used to transport passengers and goods. These trucks sometimes include eighteen or more tires, creating a large-scale tire tracking challenge. An efficient tire tracking system would speed up inventory and delivery of tires, and also keep statistics on each tire in use, such as pinpointing old or overused tires, before blowouts or other failures occur.

The Michelin Corporation has initiated such a tire tracking system for this purpose. The Michelin tire tracking system embeds RFID sensors and temperature and pressure sensors in some of its tires, which are monitored by an RF interrogation system. The interrogation system includes a remote drive-by unit (DBU) including suitable antennas that interrogate the RFID sensors as the truck, or other vehicle, drives slowly down a particular roadway. In one design, four rows of antennas are strategically placed in the roadway so that all of the inner and outer tires of the truck are interrogated by the system.

The tires include surface acoustic wave (SAW) temperature and pressure sensors and an RFID sensor including a serial number and other information. The interrogation system illuminates the sensors with an RF signal, which causes the sensors to radiate a low frequency, RF signal encoded with a tire ID, temperature, pressure and other information. The temperature and pressure sensors operate at about the 434 MHz frequency band and the RFID sensor operates at about the 915 MHz frequency band.

SUMMARY OF THE INVENTION

In accordance with the teachings of the present invention, an antenna assembly is disclosed that has particular application for a hand held reader that interrogates sensors embedded within a vehicle tire, such as RFID sensors and tire pressure sensors. In one embodiment, the antenna assembly includes a first antenna operating in the 432-435 MHz range that employs a meander-line slot that provides increased antenna cross-polarization so that the sensor can be interrogated regardless of the antenna orientation and polarization. The antenna assembly also includes two RFID antennas that operate in the 902-928 MHz range that are planar antenna that make the antenna bi-directional, polarization free and a wide enough bandwidth for the RFID interrogation.

Additional features of the present invention will become apparent from the following description and appended claims, taken in conjunction with the accompanying drawings.

DETAILED DESCRIPTION OF THE EMBODIMENTS

The following discussion of the embodiments of the invention directed to an antenna assembly for a hand held reader that interrogates sensors in a vehicle tire is merely exemplary in nature, and is in no way intended to limit the invention or its applications or uses. For example, the antenna assembly of the invention has particular application for interrogating sensors in a tire. However, as will be appreciated by those skilled in the art, the antenna assembly of the invention may have other applications.

Figure 1:
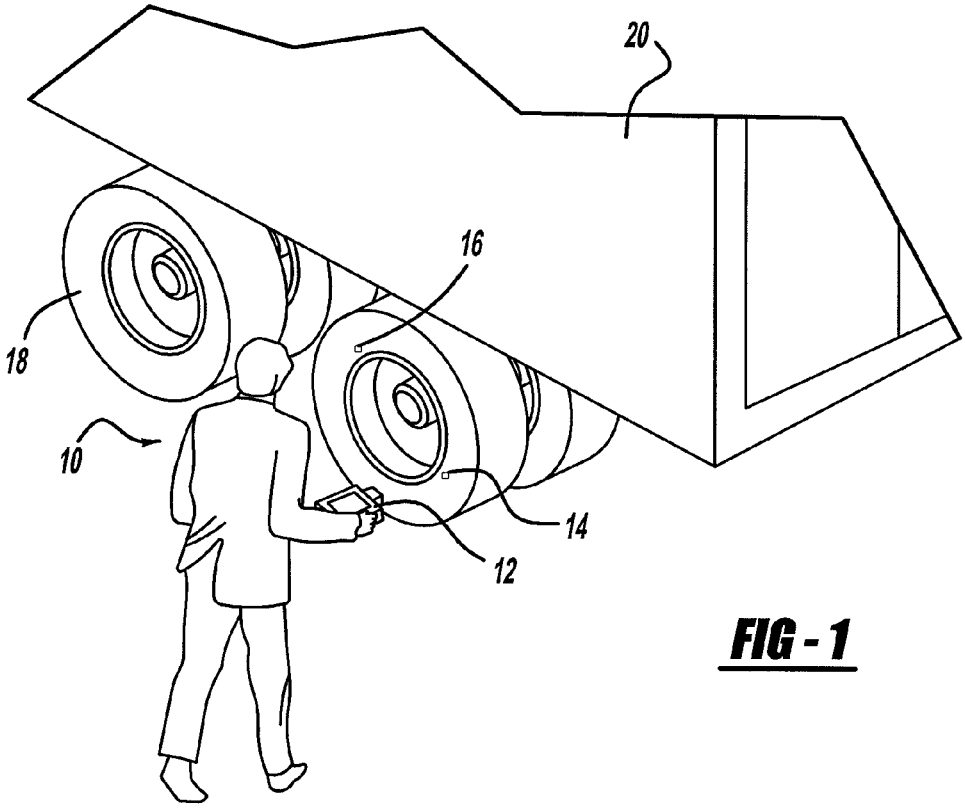
FIG. 1 is a plan view of a person holding a hand held reader that interrogates sensors within the tires of a vehicle.

FIG. 1 is a plan view of a person 10 holding a hand held reader 12. The hand held reader 12 transmits an interrogation signal to an RFID sensor 14 and a pressure sensor 16 embedded within a tire 18 of a vehicle 20. The vehicle 20 will typically be a "big rig" vehicle, where two of the tires 18 are provided side-by-side. The interrogation signal causes the sensors 14 and 16 to transmit a signal back to the hand held reader 12 with the identification and pressure information in a manner that is well understood to those skilled in the art. The sensors 14 and 16 can be any type of sensor suitable for the purposes described herein. The hand held reader 12 can also interrogate other types of sensors, such as temperature sensors.

Figure 2:
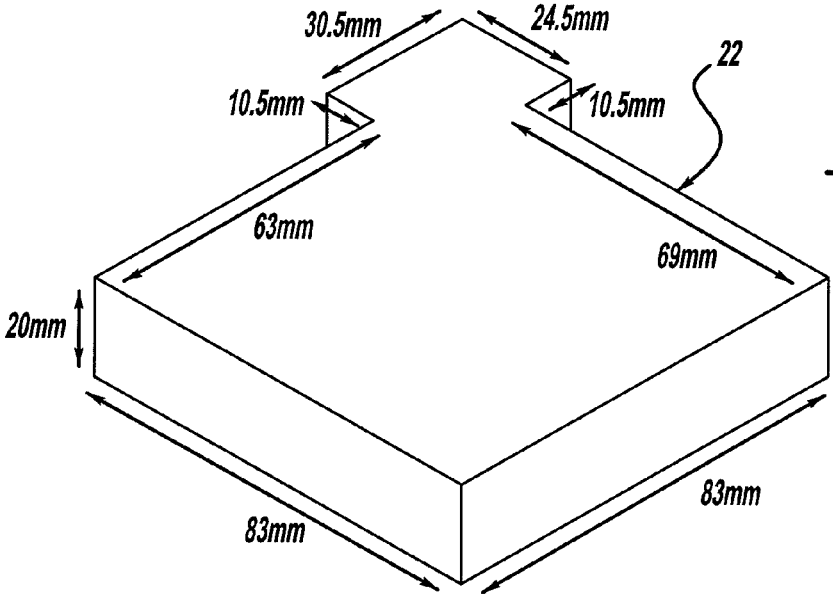
FIG. 2 is a perspective view of a housing for an antenna assembly provided in the hand held reader, according to an embodiment of the present invention.

As will be discussed in detail below, the present invention describes an antenna assembly provided within the hand held reader 12 that includes antennas for transmitting the interrogation signal to the sensors 14 and 16, and reading signals from the sensors 14 and 16. FIG. 2 is a perspective view of a housing 22 in which the antenna assembly is mounted, which gives the dimensions suitable for the hand held device 12.

Figure 3:
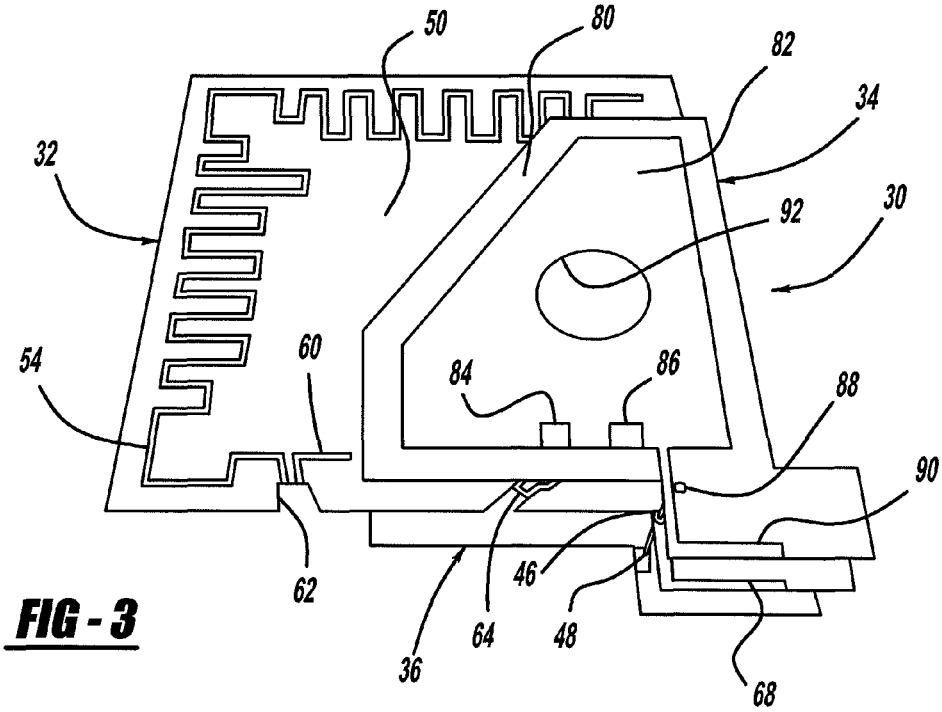
FIG. 3 is a perspective view of an antenna assembly for reading an RFID sensor and tire pressure sensor, according to an embodiment of the present invention.
Figure 4:
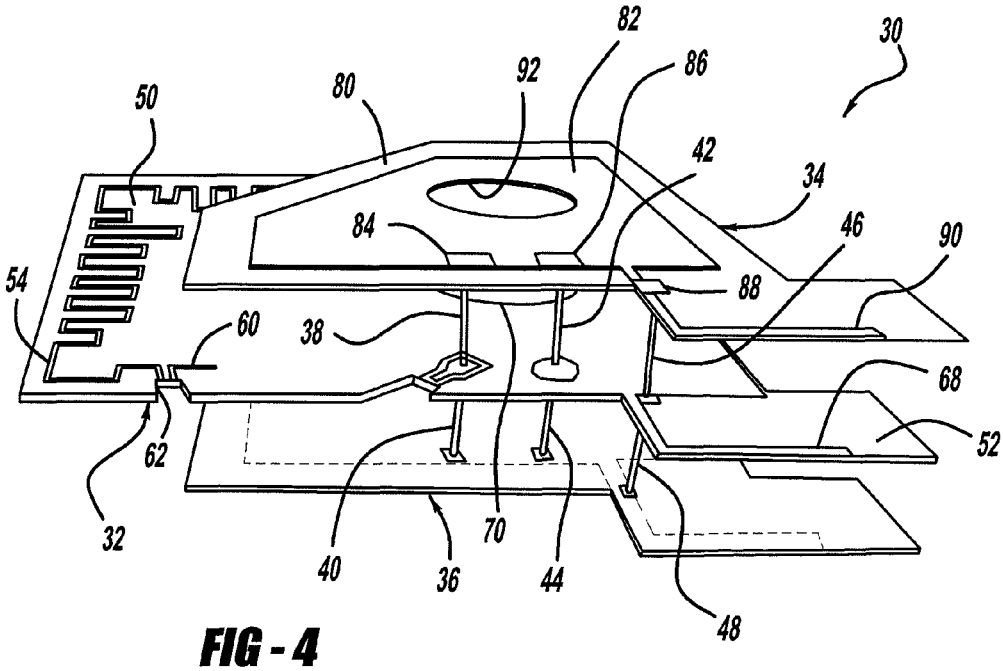
FIG. 4 is another perspective view of the antenna assembly shown in FIG. 3.

FIGS. 3 and 4 are perspective views of an antenna assembly 30 positioned within the housing 22, and suitable for use in the hand held reader 12. The antenna assembly 30 includes a tire pressure sensor antenna 32 that operates in the 432-435 MHz range for the tire pressure sensor 14 and two RFID antennas 34 and 36 that operate in the 902-928 MHz range for the RFID sensor 16. The antennas 32-36 are mounted within the housing 22 to be spaced apart, as shown. A series of connector pins are coupled to the antennas 32, 34 and 36, including RFID antenna feed pins 38 and 40 and RFID antenna matching pins 42, 44, 46 and 48, as will be discussed in detail below.

Figure 5:
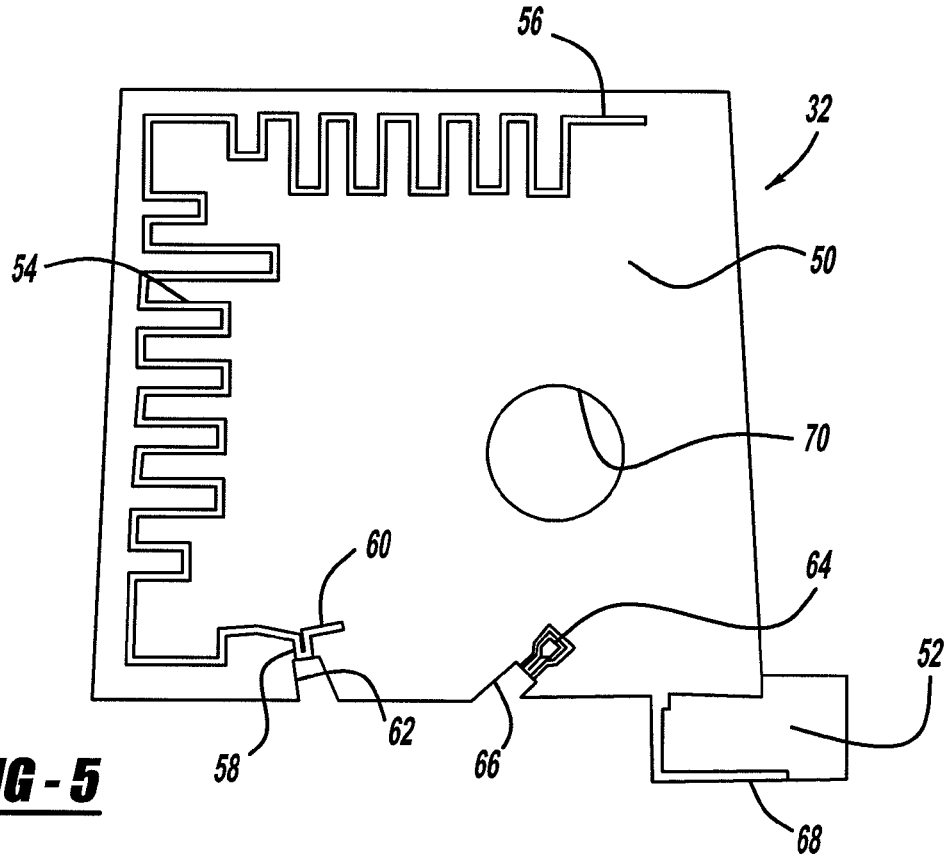
FIG. 5 is a top view of one of the antennas in the antenna assembly shown in FIGS. 3 and 4 that reads the tire pressure sensor.

FIG. 5 is a top view of the antenna 32 separated from the antenna assembly 30. The antenna 32 includes a conductive layer 50, such as copper, deposited on a dielectric substrate 52. In one non-limiting embodiment, the dielectric is Arlon 25N. A meandering slot line 54 is formed in the conductive layer 50 by any suitable process, such as etching, where the conductive layer 50 acts as a ground plane for the slot line 54. The length of the slot line 54 provides the operational frequency band of the antenna 32, and the meandering orientation of the slot line 54 increases the antenna cross polarization that makes the antenna's dominant polarization elliptical or polarization free. This allows the antenna 32 to interrogate the sensor 14 in all of the tires 18 of the vehicle 12 regardless of the orientation between the reader 12 and the sensor 14 and the polarization of the sensor 14.

The antenna 32 can be tuned to a particular frequency by changing the length of the slot line 54 at its end 56. The slot line 54 includes a feed point 58 proximate an opening 62 that accepts a suitable connector (not shown) to be coupled to the slot line 54. The connector will typically be a co-axial connector where the center conductor of the connector is coupled to the feed point 58 and the outer conductor of the connector is coupled to the conductive layer 50 that acts as a ground for the connector. However, any suitable connector can be used, such as MMCX connectors, SMA connectors, SMB connectors, FAKRA connectors, etc.

An impedance matching slot line 60 is provided on an opposite side of the slot line 54 from the feed point 58, where the slot line 60 is also coupled to the feed point 58. The slot line 60 matches the impedance of the antenna 32 to the impedance of the connector, for example, 50 ohms. The slot line 60 can be tuned to the desired impedance matching performance required for a particular application, such as S11, standing wave ratio (SWR) or voltage standing wave ratio (VSWR), by changing the length of the slot line 60. If the length of the slot line 54 is changed to tune the frequency, the standing wave ratio changes, which requires impedance tuning to the connector by changing the length of the slot line 60.

The antenna 32 also includes a feed point 64 for the RFID antenna feed pins 38 and 40 for the antennas 34 and 36, and an opening 66 for accepting a suitable connector (not shown) to be coupled to the feed point 64. The antenna 32 also includes an RFID antenna matching arm 68.

An opening 70 extending through the antenna board is used to mount the antenna 32 to the housing 22. If the antenna assembly housing 22 does not support a good tolerance for the air gap between the antennas 32-36 and the housing 22, the width of the slot line 54 may need to be made wider to increase the bandwidth.

Figure 6:
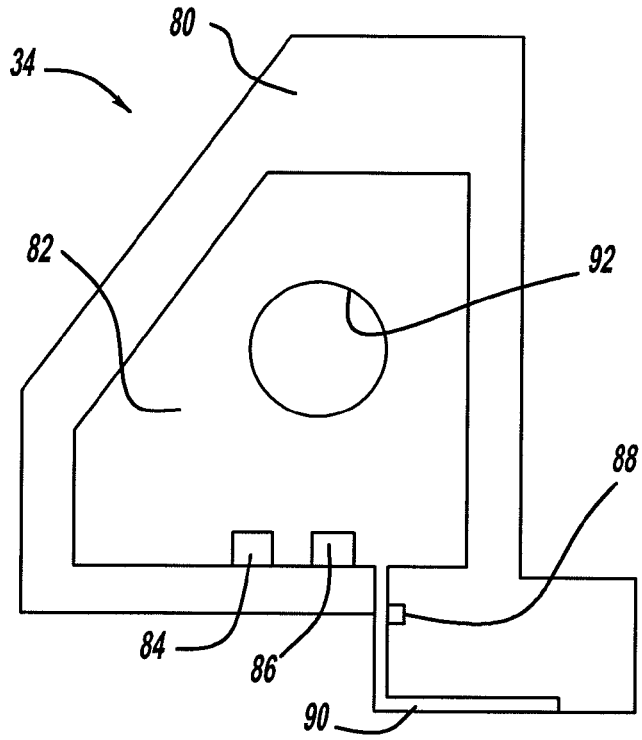
FIG. 6 is a top view of another one of the antennas in the antenna assemblies shown in FIGS. 3 and 4 that reads an RFID sensor.

FIG. 6 is a top view of the antenna 34 separated from the antenna assembly 30, where the antenna 36 is the same. The antenna 34 includes a dielectric substrate 80 and a planar antenna element 82 deposited thereon, such as a copper layer. In one non-limiting embodiment, the antennas 34 and 36 are planar inverted F antennas. Both of the planar antenna elements 82 in the antennas 34 and 36 face away from the antenna 32. The length of the planar antenna element 82 can be changed to provide frequency tuning to a desirable center frequency. The conductive layer 50 acts as the ground plane for the planar antenna element 82. Therefore, the antenna element 82 will only radiate in one direction because the conductive layer 52 blocks the radiation. However, for the hand held reader 12, it is necessary that the radiation pattern for the RFID be bi-directional, i.e., radiate in two opposite directions, so that the RFID sensors 14 on all of the tires 18 of the vehicle 20 in any orientation can be interrogated, including the inside tires 18. Therefore, the second RFID antenna 36 is required on the other side of the antenna 32.

The antenna 34 includes a coupling location 84 for the RFID antenna feed pin 38 or 40, and coupling locations 86 and 88 for the RF antenna matching pins 42 and 46 or 44 and 48. The antenna 34 also includes an impedance matching arm 90, similar to the impedance matching arm 68. The antenna input impedance can be tuned by changing the location of the matching pins 42, 44, 46 and 48. Further, if the coupling location of the matching pins 42, 44, 46 and 48 does not give the SWR desired or required, the length of the impedance matching arm 90 can be changed to fine tune the impedance matching. The antenna 34 also includes an opening 92 to allow it to be supported in the housing 22.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An antenna assembly comprising:

a first antenna including an antenna board and a planar antenna element deposited thereon;

a second antenna including an antenna board and a planar antenna element deposited thereon; and a third antenna including an antenna board and a ground layer deposited thereon, wherein a frequency slot line is formed in the ground layer, and wherein the first, second and third antennas are coupled together and spaced apart, and wherein the frequency slot line is a meandering slot line.

2. The antenna assembly according to claim 1 wherein the third antenna is positioned between the first and second antennas.

3. The antenna assembly according to claim 1 wherein the first and second antennas operate in the 902-928 MHz frequency band and the third antenna operates in the 432-435 MHz frequency band.

4. The antenna assembly according to claim 1 wherein the antenna board for the third antenna includes a feed point for the frequency slot line and a feed point for the planar antenna elements in the first and second antennas, said antenna board for the third antenna further including a cut-out portion for accepting a connector at the feed point for the frequency slot line.

5. The antenna assembly according to claim 1 further comprising a plurality of impedance matching pins for the first and second antennas, said plurality of impedance matching pins being electrically coupled to the ground layer and the planar antenna elements.

6. The antenna assembly according to claim 5 wherein the first and second antennas include an impedance matching arm coupled to the planar elements for the first and second antennas and the third antenna includes an impedance matching arm for the first and second antennas coupled to the ground layer.

7. The antenna assembly according to claim 1 wherein the third antenna includes an impedance matching slot line electrically coupled to the frequency slot line, wherein the impedance matching slot line matches the impedance of the third antenna to a connector.

8. The antenna assembly according to claim 1 wherein the frequency of the first and second antennas is tuned by extending the length of the planar antenna elements and the frequency of the third antenna is tuned by changing the length of the frequency slot line.

9. The antenna assembly according to claim 1 wherein the antenna assembly is part of a hand held reader for an interrogation system that interrogates a sensor.

10. The antenna assembly according to claim 9 wherein the first and second antennas combine to provide bi-directional, polarization free interrogation of an RFID sensor and the third antenna is elliptically polarized to provide interrogation of a pressure sensor.

11. An antenna assembly for a hand held reader that interrogates RFID sensors and pressure sensors in a vehicle tire, said antenna assembly comprising:

a first antenna including an antenna board and a planar antenna element deposited thereon;

a second antenna including an antenna board and a planar antenna element deposited thereon; and a third antenna including an antenna board and a ground layer deposited thereon, said third antenna including a meandering slot line formed in the ground layer, said antenna board for the third antenna including a feed point for the meandering slot line and a feed point for the planar antenna elements in the first and second antennas, said antenna board for the third antenna further including a cut-out portion for accepting a connector for the meandering slot line, wherein the first, second and third antennas are coupled together and spaced apart so that the third antenna is positioned between the first and second antennas, and wherein the first and second antennas combined to be bi-directional for interrogating an RFID sensor and the third antenna is elliptically polarized for interrogating a pressure sensor.

12. The antenna assembly according to claim 11 wherein the first and second antennas operate in the 902-928 MHz frequency band and the third antenna operates in the 432-435 MHz frequency band.

13. The antenna assembly according to claim 11 further comprising a plurality of impedance matching pins for the first and second antennas, said plurality of impedance matching pins being electrically coupled to the ground layer and the planar antenna elements.

14. The antenna assembly according to claim 13 wherein the first and second antennas include an impedance matching arm coupled to the planar elements for the first and second antennas and the third antenna includes an impedance matching arm for the first and second antennas coupled to the ground layer.

15. The antenna assembly according to claim 11 wherein the third antenna includes an impedance matching slot line electrically coupled to the meandering slot line, and wherein the impedance matching slot line matches the impedance of the third antenna to a connector.

16. The antenna assembly according to claim 11 wherein the frequency of the first and second antennas is tuned by extending the length of the planar antenna elements and the frequency of the third antenna is tuned by changing the length of the meandering slot line.

17. An antenna assembly for a hand held reader associated with a sensor monitoring system, said antenna assembly comprising:

a first antenna including an antenna board and a planar antenna element deposited thereon;

a second antenna including an antenna board and a planar antenna element deposited thereon; and a third antenna including an antenna board and a ground layer deposited on, said third antenna including a meandering slot line formed in the ground layer, wherein the first and second antennas combine to provide bi-directional interrogation of an RFID sensor and the third antenna is elliptically polarized to provide interrogation a pressure sensor.

18. The antenna assembly according to claim 17 wherein the antenna board for the third antenna includes a feed point for the meandering slot line and a feed point for the planar antenna elements in the first and second antennas, said antenna board for the third antenna further including a cut-out portion for accepting a connector at the feed point for the meandering slot line.

19. The antenna assembly according to claim 17 further comprising a plurality of impedance matching pins for the first and second antennas, said plurality of impedance matching pins being electrically coupled to the ground layer and the planar antenna elements.

20. An antenna assembly comprising:

a first antenna including an antenna board and a planar antenna element deposited thereon;

a second antenna including an antenna board and a planar antenna element deposited thereon; and a third antenna including an antenna board and a ground layer deposited thereon, wherein a frequency slot line is formed in the ground layer, and wherein the first, second and third antennas are coupled together and spaced apart, and wherein the antenna board for the third antenna includes a feed point for the $_{13}$frequency slot line and a feed point for the planar antenna elements in the first and second antennas, said antenna board for the third antenna further including a cut-out portion for accepting a connector at the feed point for the frequency slot line.

21. An antenna assembly comprising:

a first antenna including an antenna board and a planar antenna element deposited thereon;

a second antenna including an antenna board and a planar antenna element deposited thereon;

a third antenna including an antenna board and a ground layer deposited thereon, wherein a frequency slot line is formed in the ground layer, and wherein the first, second and third antennas are coupled together and spaced apart; and a plurality of impedance matching pins for the first and second antennas, said plurality of impedance matching pins being electrically coupled to the ground layer and the planar antenna elements.

22. An antenna assembly comprising:

a first antenna including an antenna board and a planar antenna element deposited thereon;

a second antenna including an antenna board and a planar antenna element deposited thereon; and a third antenna including an antenna board and a ground layer deposited thereon, wherein a frequency slot line is formed in the ground layer, and wherein the first, second and third antennas are coupled together and spaced apart, and wherein the third antenna includes an impedance matching slot line electrically coupled to the frequency slot line, wherein the impedance matching slot line matches the impedance of the third antenna to a connector.

23. An antenna assembly comprising:

a first antenna including an antenna board and a planar antenna element deposited thereon;

a second antenna including an antenna board and a planar antenna element deposited thereon; and a third antenna including an antenna board and a ground layer deposited thereon, wherein a frequency slot line is formed in the ground layer, and wherein the first, second and third antennas are coupled together and spaced apart, and wherein the frequency of the first and second antennas is tuned by extending the length of the planar antenna elements and the frequency of the third antenna is tuned by changing the length of the frequency slot line.

24. An antenna assembly comprising:

a first antenna including an antenna board and a planar antenna element deposited thereon;

a second antenna including an antenna board and a planar antenna element deposited thereon; and a third antenna including an antenna board and a ground layer deposited thereon, wherein a frequency slot line is formed in the ground layer, and wherein the first, second and third antennas are coupled together and spaced apart, and wherein the antenna assembly is part of a hand held reader for an interrogation system that interrogates a sensor.

* * * * *